United States Patent [19]

Okumura et al.

[11] Patent Number: 4,926,648

[45] Date of Patent: May 22, 1990

[54] TURBOMOLECULAR PUMP AND METHOD OF OPERATING THE SAME

[75] Inventors: Katsuya Okumura; Fumio Kuriyama; Yukio Murai; Manabu Tsujimura; Hiroshi Sobukawa, all of Kanagawa, Japan

[73] Assignees: Toshiba Corp.; Ebara Corp., both of Tokyo, Japan

[21] Appl. No.: 318,206

[22] Filed: Mar. 3, 1989

[30] Foreign Application Priority Data

Mar. 7, 1988 [JP] Japan ..... 63-51623

[51] Int. Cl.[5] ..... B01D 8/00

[52] U.S. Cl. ..... 62/55.5; 415/90; 417/901

[58] Field of Search ..... 415/90; 62/55.5; 417/901

[56] References Cited

U.S. PATENT DOCUMENTS

| | | | |
|---|---|---|---|
| 3,149,775 | 9/1964 | Pagano | 62/55.5 |
| 3,396,548 | 8/1968 | Matte | 62/55.5 |
| 3,579,998 | 5/1971 | Thibault | 62/55.5 |
| 3,597,267 | 7/1986 | Forrest | 62/55.5 |
| 3,625,019 | 12/1971 | Osterstrom | 66/55.5 |
| 3,769,806 | 11/1973 | Boissin et al. | 62/55.5 |
| 4,176,526 | 12/1979 | Missimer | 62/278 |
| 4,438,632 | 3/1984 | Lessard et al. | 62/55.5 |
| 4,535,597 | 8/1985 | Missimer | 62/55.5 |

FOREIGN PATENT DOCUMENTS

| | | |
|---|---|---|
| 7312372 | 3/1973 | Fed. Rep. of Germany . |
| 57-212395 | 12/1982 | Japan . |
| 59-90784 | 5/1984 | Japan . |
| 60-161702 | 8/1985 | Japan . |
| 62-168994 | 7/1987 | Japan . |

OTHER PUBLICATIONS

Soviet Inventions Illustrated, Section P/Q, week E39, 10th Nov. 1982, class Q, No. M8488E/30, Derwent Publications Ltd., London, GB; & Su-A-881 372 (Tuzankin Yu M) 11-04-190.

*Primary Examiner*—Ronald C. Capossela
*Attorney, Agent, or Firm*—Armstrong, Nikaido, Marmelstein, Kubovcik & Murray

[57] ABSTRACT

A turbomolecular pump having a rotor provided with a plurality of rotor blades and a spacer provided with a plurality of stator blades so that gas molecules are sucked in from a suction port, compressed and discharged from an exhaust port. The pump further has a heat exchanger provided inside the suction port, the heat exchanger being connected to a refrigerator through a refrigerant pipe and a gate valve provided on the upstream side of the suction port. Gases having low molecular weights, particularly water vapor, are freeze-trapped on the heat exchanger. Thus, it is possible to efficiently exhaust gases having low molecular weights, particularly water vapor, and hence to obtain a high vacuum of good quality. In addition, it is easy to start and suspend operation of the system and possible to run it on a continuous basis.

11 Claims, 7 Drawing Sheets

TURBOMOLECULAR PUMP AND METHOD OF OPERATING THE SAME

BACKGROUND OF THE INVENTION

1. Field of the Invention

The present invention relates to a vacuum pump, that is, a turbomolecular pump, wherein a plurality of rotor and stator blades which are combined together are rotated relative to each other under a low pressure such that any collision between gas molecules is negligible to effect exhaustion of a gas. The present invention also pertains to a method of operating a vacuum pump of the type described above.

2. Description of the Prior Art

A typical conventional turbomolecular pump will first be explained with reference to FIG. 1.

A conventional turbomolecular pump which is generally denoted by the reference numeral 1 includes a motor 2, a motor shaft 3 for transmitting the rotational force derived from the motor 2, a rotor 4 secured to the motor shaft 3, a plurality of rotor blades 5 fixed to the rotor 4, a plurality of stator blades 6 each disposed between a pair of adjacent rotor blades 5, a spacer 7 having the stator blades 6 attached thereto, a casing 10 provided with a suction port 8 and an exhaust port 9, and a protective net 11 for protecting the rotor and stator blades 5 and 6. In operation, the motor 2 is driven to rotate the rotor blades 5 at high speed in a high-vacuum atmosphere sufficient to ensure that molecular flow is available, thereby sucking gas molecules from the suction port 8, compressing the gas at a high compression ratio and moving the gas toward the exhaust port 9, thus producing a high vacuum.

The above-described conventional turbomolecular pump suffers, however, from the following problems. The gas exhausting performance of the pump depends on the molecular weight of a gas being handled by it. When a gas having a low molecular weight is being handled, the gas exhausting performance deteriorates to a considerable extent. The lower the compression ratio, the lower the gas exhausting performance. The blade speed ratio C, a parameter representing the compression ratio, is expressed as follows:

$$C=V/Vm$$

(wherein V is the peripheral speed of the rotor blades and Vm is the maximum probability speed of gas molecules).

The maximum probability speed Vm of gas molecules is expressed as follows:

$$Vm = \sqrt{(2KT/M)}$$

(wherein M is the molecular weight of the gas, K is Boltzmann's constant, and T is the absolute temperature of the gas).

As will be clear from these expressions, the lower the molecular weight M of the gas, the higher the maximum probability speed Vm of the gas molecules and the lower the blade speed ratio C. Therefore, when a gas having a low molecular weight is being handled, the gas exhausting performance is low. Many problems are likely to occur in actual operation of the turbomolecular pump when the gas exhausting performance is low.

Among the problems associated with gases having low molecular weights, the existence of water vapor, in particular, adversely affects the gas exhausting performance of the pump. In a system wherein a part of the system that is provided with a turbomolecular pump is open to the atmosphere and air flows into the system, the greater part of the residual gas under a vacuum of about $10^{-4}$ Torr to $10^{-10}$ Torr ($10^{-4}$ mmHg to $10^{-10}$ mmHg) which is produced by the turbomolecular pump is water vapor. The residual water vapor has adverse effects on the degree of vacuum and the vacuum environment.

In the case of using a cryo-vacuum pump that employs a helium refrigerator and a heat exchanger which provides ultra-low temperatures of from about 15° K. to about 20° K, the gas exhausting characteristics in regard to water vapor are improved and it is therefore possible to cope with the above-described problems to a certain extent. However, such a cryo-vacuum pump involves the following problems:

(1) Since a refrigerator for ultra-low temperatures is used, it takes a long time to start and suspend the system.

(2) Since the pump is a capture type one, i.e. it freezes and traps most gas molecules, it must be regenerated for a long period every time a predetermined load is run and completed.

(3) Since the sublimation temperature differs depending upon the kind of gas molecules, various kinds of gas molecules are separated from each other and successively discharged from the pump at high concentrations as the temperature of the heat exchanger rises during a regenerative operation, and it is difficult to treat various kinds of gases which are discharged separately. In particular, in semiconductor manufacturing processes, toxic, highly-corrosive, explosive and combustible gases, for example, monosilane ($SiH_4$), hydrogen fluoride (HF), etc., are used that are diluted with inert gases such as nitrogen ($N_2$), helium (He), etc., and it is therefore extremely difficult to handle these various kinds of gases that are discharged separately.

It might be considered possible to combine the conventional turbomolecular pump and cryo-vacuum pump in order to overcome the above-described problems. However, with such a combination, most gas molecules exclusive of hydrogen and helium molecules would be freeze-trapped in the cryo-vacuum pump and therefore the provision of the turbomolecular pump would become meaningless.

SUMMARY OF THE INVENTION:

In view of the above-described disadvantages of the prior art, it is an object of the present invention to provide a turbomolecular pump the operation of which is capable of effectively exhausting gases having low molecular weights, particularly water vapor, and the operation of which is easy to start and suspend, as well as being capable of operating on a continuous basis.

It is another object of the present invention to provide a method of operating the above-described turbomolecular pump.

To these ends, according to one of its aspects, the present invention provides a turbomolecular pump having a rotor provided with a plurality of rotor blades and a spacer provided with a plurality of stator blades so that gas molecules are sucked in from a suction port, compressed and discharged from an exhaust port, wherein the improvement comprises: a heat exchanger provided inside the suction port, the heat exchanger being connected to a refrigerator through a refrigerant pipe; and a gate valve provided on the upstream side of the suction port.

The refrigerator preferably has the capability of supplying a refrigerant cooled to from about −100° C. to about −190° C. and it is preferable either to employ as the refrigerator one which is capable of defrosting or, if the refrigerator is not capable of defrosting, to further provide a heater at the suction port.

According to another of its aspects, the present invention provides a method of operating a turbomolecular pump comprising: an exhaust step in which a gate valve provided on the upstream side of a suction port is opened and, in this state, water vapor is freeze-trapped by a heat exchanger provided inside the suction port; and a regeneration step in which, with the gate valve closed, the water vapor freeze-trapped is thawed and released.

The regeneration step preferably includes either the step of switching over the operating mode of a refrigerator from the refrigerating mode to the defrost mode or the step of effecting, with the refrigerating capacity of the refrigerator maintained or lowered, heating in excess of the refrigerating capacity by means of a heater which is provided at the suction port. The regeneration step, however, may also be effected by just closing a gate valve and continuing the exhaust operation of a turbomolecular pump.

To conduct a gas exhausting operation, the gate valve provided on the upstream side of the suction port is opened and the refrigerator is run in the refrigerating mode to deliver a refrigerant to the heat exchanger so as to cool it. Further, the rotor blades are rotated to suck a gas into the pump. At this time, water vapor contained in the gas is selectively freeze-trapped by the heat exchanger. As a result, the gas exhausting performance of the turbomolecular pump is improved and it is therefore possible to produce a high vacuum of good quality. A gas having a low molecular weight which is not freeze-trapped, for example, hydrogen, helium, etc., is also cooled by the heat exchanger and this brings down the gas temperature, which in turn results in a reduction in the speed of the gas molecules. Accordingly, the blade speed ratio C increases and the gas exhausting performance of the turbomolecular pump is improved. Thus, it is possible to eliminate the problems associated with the conventional turbomolecular pump, that is, the inferior performance displayed in exhausting gases having low molecular weights, particularly water vapor.

After the gas exhausting operation has been conducted for a predetermined period of time, it is necessary to carry out a regenerative operation in which water vapor which has been freeze-trapped on the heat exchanger is thawed and released. In such a regenerative operation, it is only necessary to heat the water vapor freeze-trapped on the heat exchanger with the gate valve closed. The heating may be effected by switching over the operating mode of the refrigerator from the refrigerating mode to the defrost mode to thereby conduct heating through the heat exchanger, or by maintaining or lowering the refrigerating capacity of the refrigerator and effecting, in this state, heating in excess of the refrigerating capacity by means of a heater provided at the suction port. The freeze-trapped water vapor sublimates by absorbing heat from either the heat exchanger or the heater and is then discharged from the exhaust port by the interaction between the rotor and stator blades. In this way, the regeneration step is carried out. Thus, the time required to switch over to the regeneration step and to complete the regeneration is reduced by a large margin.

The regeneration operation may also be effected by just continuing the exhaust operation of the turbomolecular pump with the gate valve closed. In this case, the heating of the water vapor as stated above is not necessary.

This regenerative operation can be conducted by the use of the gate valve cut-off time during normal operation of a turbomolecular pump in, for example, a semiconductor manufacturing process, and this makes it possible to run the turbomolecular pump on a continuous basis without requiring a specific time for regeneration.

Thus, the present invention provides a turbomolecular pump which enables gases having low molecular weights, particularly water vapor, to be efficiently exhausted, while maintaining the advantages of the conventional turbo-molecular pump, namely, that it is easy to start and suspend the operation of the system and also possible to run it on a continuous basis. It should be noted that the present invention enables selection of a desired configuration and heat-exchange area of the heat exchanger on the basis of the constituents of a gas to be exhausted and the exhaustion time.

BRIEF DESCRIPTION OF THE DRAWINGS

The above and other objects, features and advantages of the present invention will become more apparent from the following description of the preferred embodiments thereof, taken in conjunction with the accompanying drawings, in which like reference numerals denote like elements and, of which.

DETAILED DESCRIPTION OF THE PREFERRED EMBODIMENTS

Embodiments of the present invention wil be described hereinunder in detail with reference to FIGS. 2 to 7.

Figure 1:
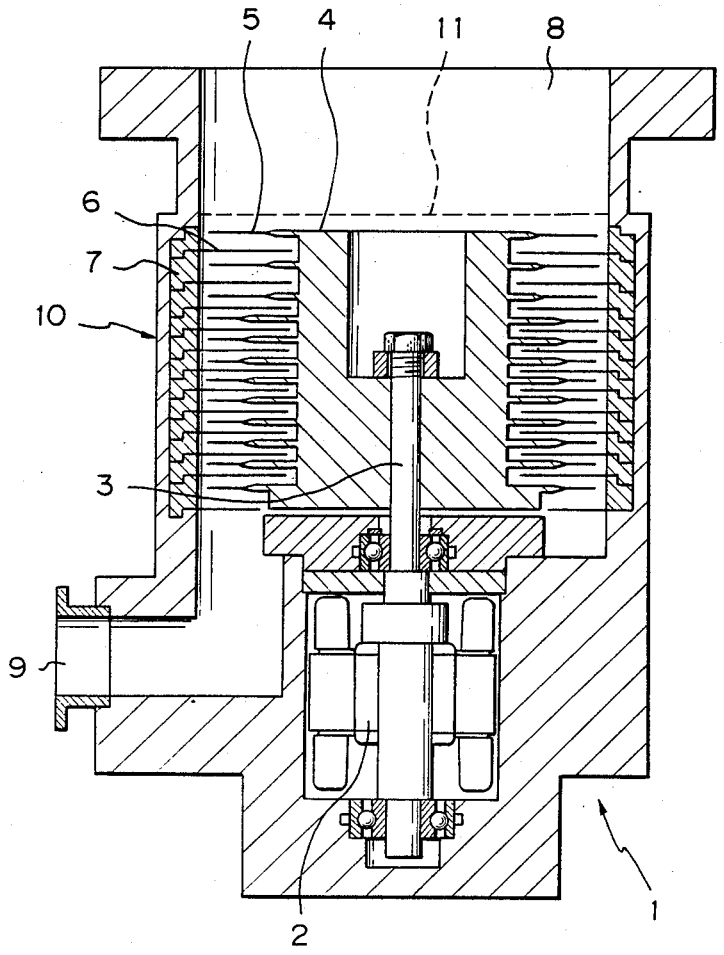
Fig. 1 PRIOR ART
FIG. 1 is a sectional front view of a conventional turbomolecular pump.
Figure 2:
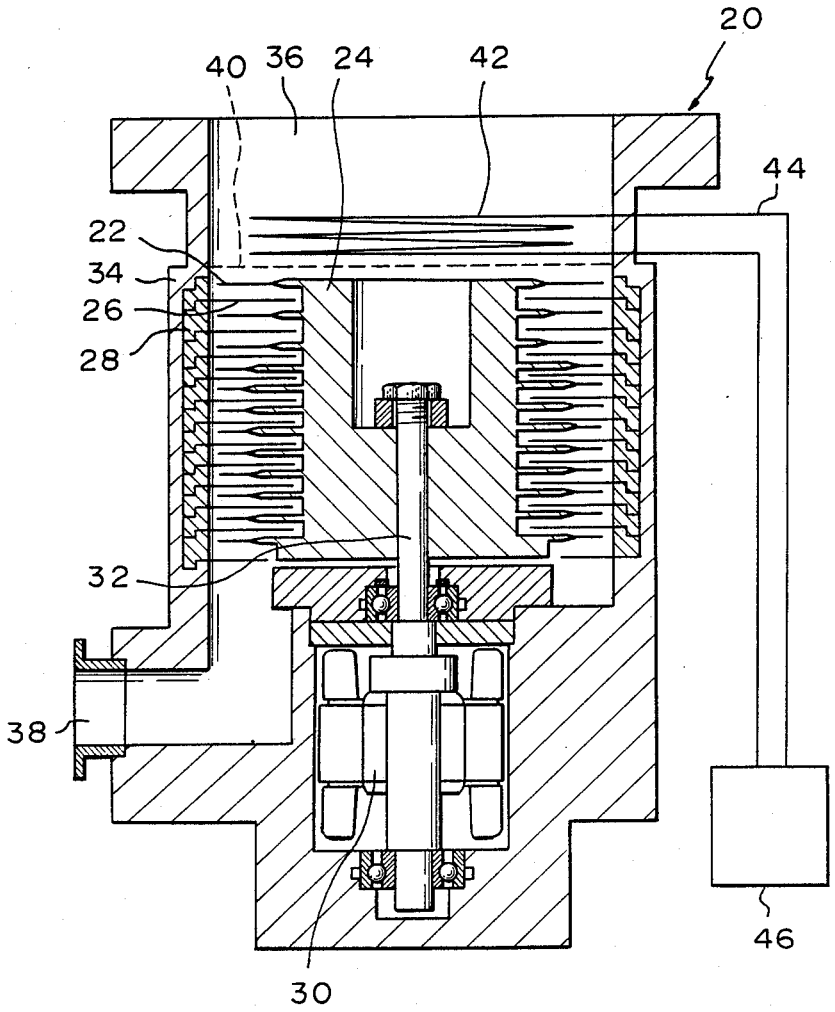
FIG. 2 is a sectional front view of a first embodiment of the turbomolecular pump according to the present invention.
Figure 3A:
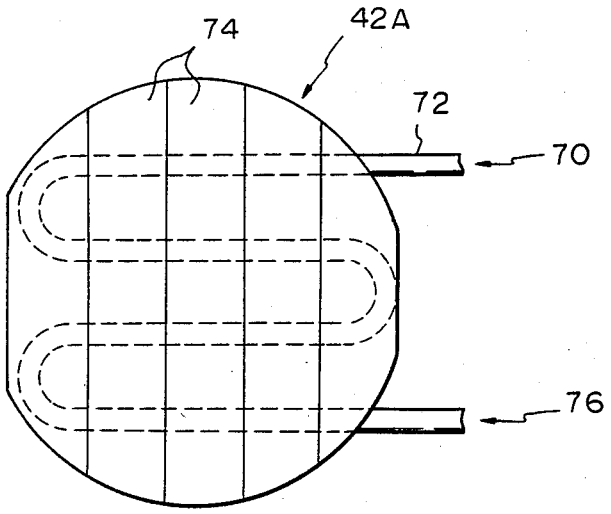
FIG. 3A is a plan view of one example of the heat exchanger shown in FIG. 2.
Figure 3B:
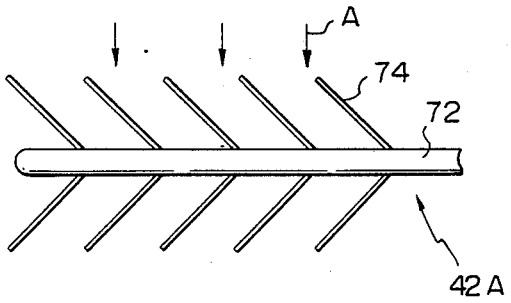
FIG. 3B is a front view of the heat exchanger shown in FIG. 3A.

FIG. 2 shows a first embodiment if the present invention. A turbomolecular pump which is generally denoted by the reference numeral 20 has a rotor 24 provided with a plurality of rotor blades 22 and a spacer 28 having a plurality of stator blades 26 attached thereto, each stator blade 26 being disposed between a pair of adjacent rotor blades 22. The rotor 24 is secured to a motor shaft 32 of a motor 30. The spacer 28 is fixed within a casing 34. The casing 34 is provided with a suction port 36 and an exhaust port 38. A protective net 40 for protecting the rotor and stator blades 22 and 26 is provided on the downstream side of the suction port 36 (i.e., the side of the suction port 36 which is closer to the exhaust port 38 as viewed in the direction of the flow of gas) and at the upstream side of the rotor and stator blades 22 and 26. A gate valve (not shown) is disposed on the upstream side of the suction port 36.

In addition to the above-described arrangement, the turbomolecular pump 20 shown in FIG. 2 has a heat exchanger 42 which is provided at the suction port 36. The heat exchanger 42 is connected to a refrigerator 46 through a refrigerant pipe 44. The refrigerator 46 is of the type in which either a low-temperature refrigerant fluid or an ordinary-temperature refrigerant fluid (or hot gas) can be selectively supplied through the refrigerant pipe 44 by actuating a selector valve incorporated therein (not shown), thereby enabling the refrigerating mode and the defrost mode to be switched over from one to the other within a short time, as is disclosed, for example, in U.S. Pat. No. 4,176,526.

The heat exchanger 42 shown in FIG. 2 may be arranged as shown in FIGS. 3A to 5B. The heat exchanger 42A shown in FIGS. 3A and 3B comprises a flat heat transfer coil 72 and a plurality of heat transfer plates 74 blazed on upper and lower sides of said that transfer coil in spaced relationship to each other so that gas molecules sucked in from said suction port pass therebetween. The exchanger 42A is supplied with a cooled refrigerant through the refrigerant pipe 44 (see FIG. 2) from the refrigerator 46 (see FIG. 2). The refrigerant enters the heat exchanger 42A through a refrigerant inlet 70, cools the heat transfer coil 72 and heat transfer plates 74 and returns to the refrigerator 46 from a refrigerant outlet 76. When water vapor molecules collide with the cooled heat transfer coil 72 and the cooled heat transfer plates 74, the molecules are freeze-trapped with a predetermined probability. It should be noted that the arrow A shown in FIG. 3B indicates the flow of gas that is sucked into the turbomolecular pump 20.

Figure 4A:
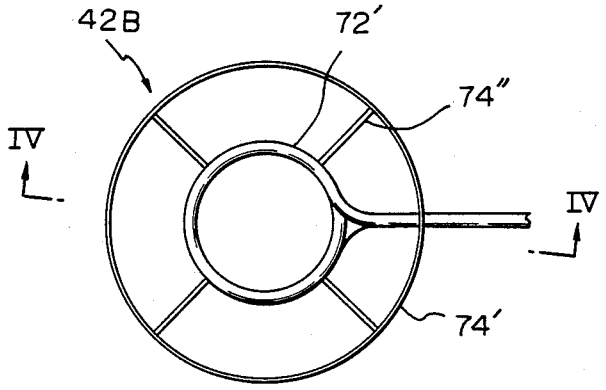
FIG. 4A is a plan view of another example of the heat exchanger.
Figure 4B:
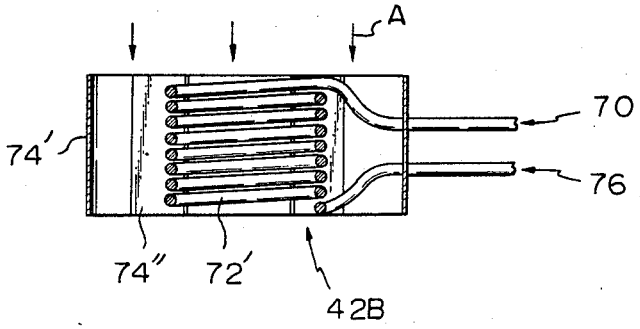
FIG. 4B is a sectional front view of the heat exchanger taken along line IV—IV in FIG. 4A.

The heat exchanger 42B that is shown in FIGS. 4A and 4B, comprises a cylindrical heat transfer coil 72', a cylindrical heat transfer member 74' concentrically encircling said heat transfer coil, and a plurality of radial heat transfer plates 74'' blazed between said heat transfer coil 72' and the transfer member 74'. The heat transfer coil 72', heat transfer member 74' and heat transfer plates 74'' are disposed parallel to the flow of gas molecules sucked in from said suction port, minimizing the flow resistance.

Figure 5A:
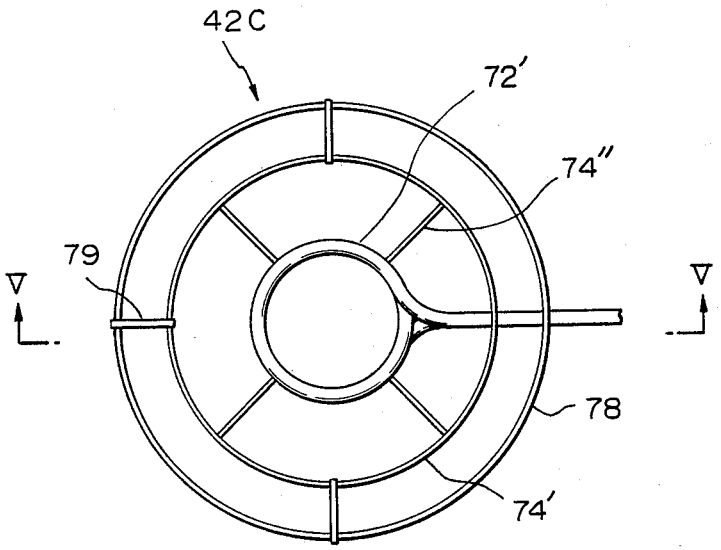
FIG. 5A is a plan view of still another example of the heat exchanger.
Figure 5B:
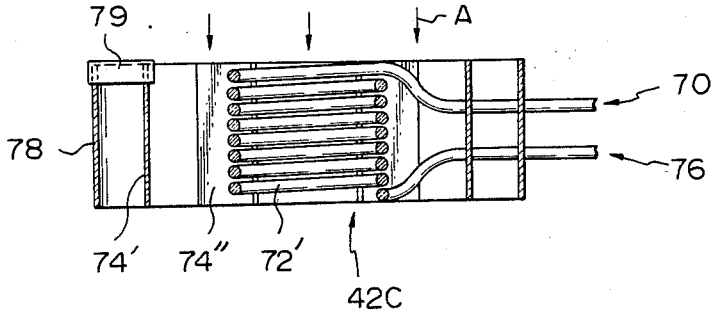
FIG. 5B is a sectional front view of the heat exchanger taken along line V—V in FIG. 5A.

In the heat exchanger 42C shown in FIGS. 5A and 5B, a cylindrical heat shield member 78 is concentrically attached by means of plates 79 to the outside of a heat exchanger 42C having the same arrangement as that shown in FIGS. 4A and 4B and serves to minimize heat loss (absorption of heat) due to radiation heat transfer.

The operation of the embodiment shown in FIG. 2 will next be expained. To carry out the exhaust step, the gate valve (not shown) provided on the upstream side of the suction port 36 is opened and the refrigerator 46 is run in the refrigerating mode to supply low-temperature refrigerant to the heat exchanger 42. In addition, the motor 30 is rotated to suck in a gas through the suction port 36. In consequence, water vapor contained in the gas is freeze-trapped by the heat exchanger 42. As a result, the gas exhausting efficiency of the turbomolecular pump shown in FIG. 2 increases, so it is possible to obtain a high vacuum of good quality. Gas molecules (hydrogen, helium, etc.) having low molecular weights, exclusive of water vapor, are not freeze-trapped, but the gas temperature lowers through collision or contact of these gas molecules with the heat exchanger 42, so that the blade speed ratio increases and thus the gas exhausting performance of the pump 20 is improved.

Figure 6:
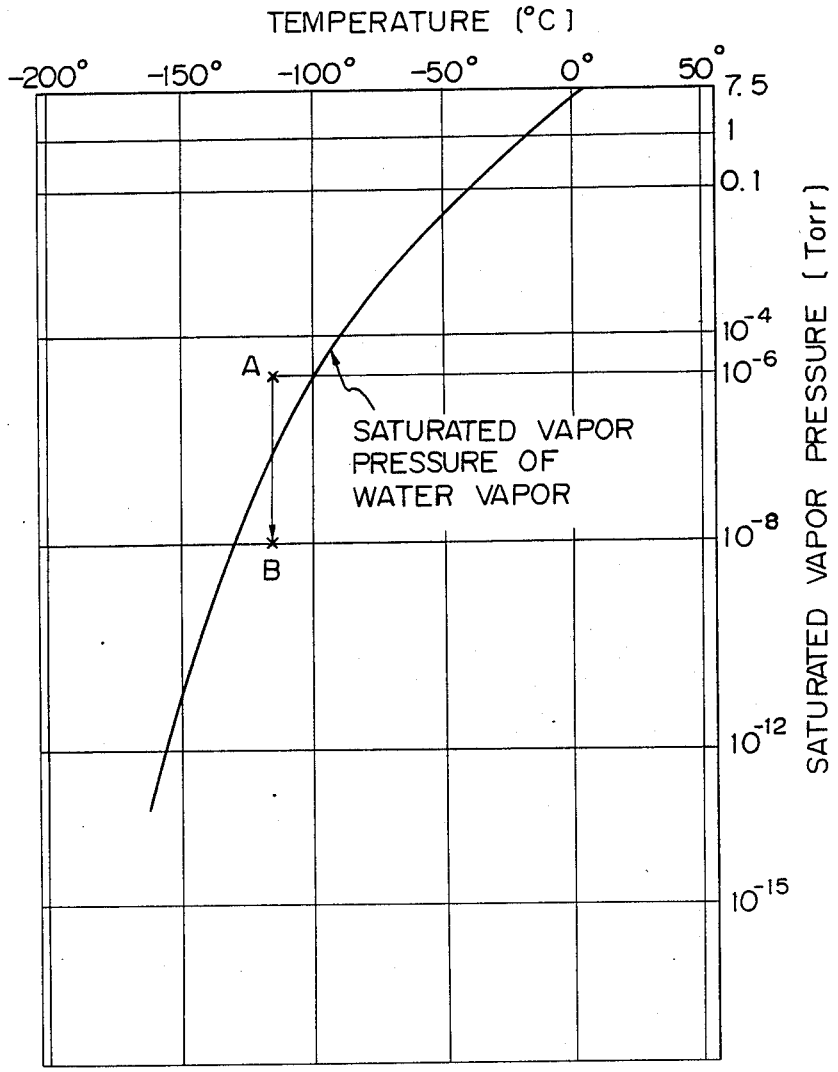
FIG. 6 is a graph showing the saturated vapor pressure of water vapor.

Referring to FIG. 6, which is a graph showing the saturated vapor pressure of water vapor, at −85° C. the saturated vapor pressure of water vapor is $10^{-4}$ Torr ($10^{-4}$ mmHg), and at 140° C., $10^{-10}$ Torr ($10^{10}$ mmHg). Therefore, as will be understood from the graph, the strength of the resulting vacuum is increased by conducting the gas exhausting operation while freeze-trapping water vapor.

Noting that the graph of FIG. 6 shows equilibrium conditions, it is considered necessary to cool water vapor to temperatures lower than the temperature range of from −85° C. to −140° C. in order to obtain a vacuum pressure range of from $10^{-4}$ Torr to $10^{-4}$ Torr in the light of the need for mechanical efficiency, etc. For this reason, the embodiment shown in FIG. 2 employs a refrigerant source that provide temperatures of from −100° C. to −190° C.

To conduct a regenerative operation for thawing and releasing the freeze-trapped molecules after the gas exhausting operation has been carried out for a predetermined period of time by use of the turbomolecular pump 20 shown in FIG. 2, the gate valve (not shown in FIG. 2 but identical with the member denoted by reference numeral 90 in FIG. 7) which is disposed on the upstream side of the suction port 36 is closed and the refrigerator 46 is switched to the defrost mode, thereby supplying an ordinary-temperature refrigerant fluid or hot gas to the heat exchanger 42 so as to heat it. As a result, the water vapor freeze-trapped on the heat exchanger 42 sublimates by absorbing heat from the heat exchanger 42 and is then discharged by the interaction between the rotor blades 22 and the stator blades 26.

Figure 7:
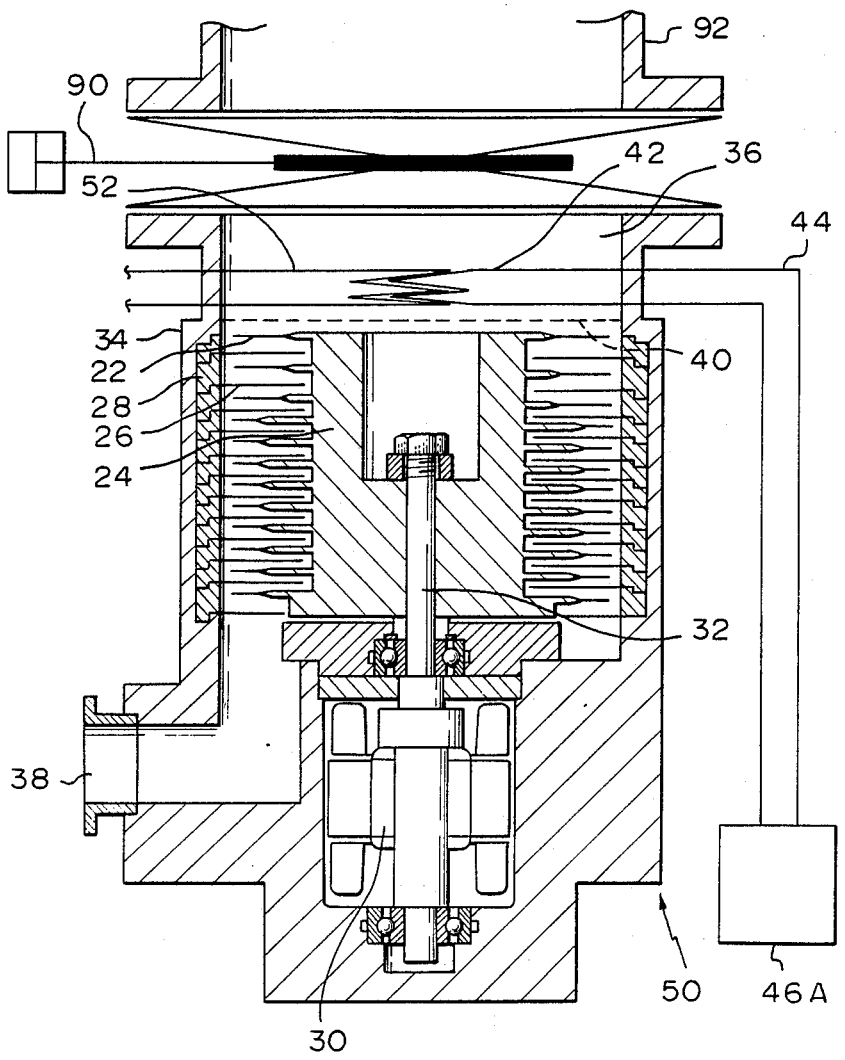
FIG. 7 is a sectional front view of a second embodiment of the present invention.

A second embodiment of the present invention will next be explained with reference to FIG. 7. In FIG. 7, members which are the same as those shown in FIG. 2 are denoted by the same reference numerals.

In the embodiment shown in FIG. 7, a heater 52 is provided at the suction port 36 in addition to the heat exchanger 42. The refrigerator 46A need not necessarily be capable of defrosting. In this embodiment, the exhaust step is the same as that in the embodiment shown in FIG. 2, but in the regeneration step, with the refrigerating capacity of the refrigerator 46A maintained or lowered, heating is conducted in excess of the refrigerating capacity by means of the heater 52. As a result, the water vapor that has been freeze-trapped on the heat exchanger 42 is sublimated on being heated by the heater 52 and is discharged by the interaction between the rotor and stator blades 22 and 26. It should be noted that the reference numeral 90 shown in FIG. 7 denotes a gate valve, and 92 a vacuum vessel or a pipe which is connected thereto.

In this embodiment, it is unnecessary to switch over the operating mode of the refrigerator between the refrigerating mode and the defrost mode and there is therefore no need for a long rise time as would otherwise be required when the operating modes are switched over from one to the other. Thus, it is possible to further increase the efficiency of the operating cycle comprising the exhaust step and the regeneration step.

The regenerative step may also be conducted by just closing the gate valve and continuing the exhaust operation of the turbomolecular pump. Namely, in the turbomolecular pump shown in FIG. 7, when the gate valve is closed and the exhaust operation of the turbomolecular pump is continued, the vapor pressure in a space downstream of the suction port 36, i.e. a trap room, is reduced and sublimation of the water vapor freeze-trapped on the heat exchanger 42 is thereby caused or increased. For example, suppose the temperature in the trap room is $-120°$ C. and the water vapor pressure in the trap room before closing the gate valve is $6\times10^{-6}$ Torr (point A in FIG. 6). In this state, if the gate valve is closed and the exhaust operation is continued, the water vapor pressure in the trap room would be reduced to about $1\times10^{-8}$ Torr (point B in FIG. 6). Thus, the water vapor freeze-trapped on the heat exchanger 42 is sublimated and discharged by the interaction between the rotor and stator blades 22 and 26 to provide a regenerative operation.

Such a regenerative operation does not need the switching over of the refrigerator 46A between the refrigerating mode and the defrost mode, as is needed in the first embodiment, or the heating of the heat exchanger 42, as is needed in the second embodiment. Thus there is no need for a specific time to be used solely for the regenerative step. The regenerative operation can be conducted by the use of the gate valve cut-off time during a normal driving process of a turbomolecular pump in, for example, a semiconductor manufacturing process. Thus, it is possible to operate the turbomolecular pump on a continuous basis and to further increase the efficiency of the turbomolecular pump as compared with the first and second embodiments.

As has been described above, it is possible according to the turbomolecular pump of the present invention to eliminate the problems caused by the existence of gas molecules having low molecular weights, particularly water vapor contained in the gas which is to be exhausted, and yet to enable the operation of the system to be readily started and suspended. Accordingly, it is possible to obtain a high vacuum of good quality within a short period of time.

In addition, the turbomolecular pump according to the present invention is provided with an independent heat exchanger not for the purpose of cooling a part of a constituent element of the pump, for example, the casing or stator blades, but for the purpose of freeze-trapping gas molecules. It is therefore possible to select a desired configuration and heating area of the heat exchanger on the basis of the constituents of the gas to be exhausted and the exhaustion time.

Although the present invention has been described through specific terms, it should be noted here that the described embodiments are not exclusive and that various changes and modifications may be imparted thereto without departing from the scope of the invention which is limited solely by the appended claims.

What is claimed is:

1. A turbomolecular pump having a rotor provided with a plurality of rotor blades and a spacer provided with a plurality of stator blades so that gas molecules are sucked in from a suction port, compressed and discharged from an exhaust port by the interaction between said rotor and stator blades, wherein the improvement comprises:

a heat exchanger provided inside said suction port, said heat exchanger being connected to a refrigerator through a refrigerant pipe; and a gate valve provided on the upstream side of said suction port.

2. A turbomolecular pump as claimed in claim 1, wherein said refrigerator has the capability of supplying a refrigerant cooled to from about $-100°$ C. to about $-190°$ C.

3. A turbomolecular pump as claimed in claim 1, wherein said refrigerator is capable of defrosting.

4. A turbomolecular pump as claimed in claim 1, wherein said turbomolecular pump further comprises a heater inside said suction port.

5. A turbomolecular pump as claimed in claim 1, wherein said heat exchanger comprises a flat heat transfer coil and a plurality of heat transfer plates blazed on upper and lower sides of said heat transfer coil in spaced relationship to each other so that gas molecules sucked in from said suction port pass therebetween.

6. A turbomolecular pump as claimed in claim 1, wherein said heat exchanger comprises a cylindrical heat transfer coil, a cylindrical heat transfer member concentrically encircling said heat transfer coil and a plurality of radial heat transfer plates blazed between said heat transfer coil and heat transfer member, said heat transfer coil, heat transfer member and heat transfer plates being disposed parallel to the flow of gas molecules sucked in from said suction port.

7. A turbomolecular pump as claimed in claim 6, wherein said heat exchanger further comprises a cylindrical heat shield member concentrically encircling and attached to the outside of said cylindrical heat transfer member.

8. A method of operating a turbomolecular pump comprising:

an exhaust step in which a gate valve provided at the upstream side of a suction port is opened and, in this state, water vapor is freeze-trapped by a heat exchanger provided inside said suction port; and a regeneration step in which, with said gate valve closed, the water vapor freeze-trapped is thawed and released.

9. A method of operating a turbomolecular pump as claimed in claim 8, wherein said heat exchanger is connected to a refrigerator through a refrigerant pipe, and said regeneration step includes a step of switching over said refrigerator from a refrigerating mode to a defrost mode.

10. A method of operating a turbomolecular pump as claimed in claim 8, wherein said heat exchanger is connected to a refrigerator through a refrigerant pipe, said turbo-molecular pump includes a heater inside said suction port, and said regeneration step includes a step of heating said heater in excess of the refrigeration capacity of said refrigerator with the refrigerating capacity of said refrigerator maintained or lowered.

11. A method of operating a turbomolecular pump as claimed in claim 8, wherein said regeneration step is conducted by continuing the exhaust operation of said turbomolecular pump with said gate valve closed.

* * * * *